United States Patent [19]

Herbst

[11] 3,974,672

[45] Aug. 17, 1976

[54] MILL HYDRAULIC SCREW-DOWN

[76] Inventor: John F. Herbst, 175 Taylor Ave., Cheshire, Conn. 06410

[22] Filed: Sept. 19, 1975

[21] Appl. No.: 615,102

[52] U.S. Cl. ..... 72/21; 72/35; 72/245

[51] Int. Cl.[2] ..... B21B 37/08; B21B 31/34; B21B 31/32

[58] Field of Search ..... 72/21, 31, 35, 34, 245, 72/8

[56] References Cited

UNITED STATES PATENTS

| | | | |
|---|---|---|---|
| 3,570,288 | 3/1971 | Fischer et al. | 72/8 |
| 3,587,279 | 6/1971 | Sendzimir et al. | 72/21 X |

*Primary Examiner*—Milton S. Mehr
*Attorney, Agent, or Firm*—Roylance, Abrams, Berdo & Kaul

[57] ABSTRACT

A hydraulically driven mill screw-down including an optical encoder directly coupled to the hydraulic drive for producing digital signals representative of motion and direction of motion of the movable roll, a bidirectional counter for maintaining a cumulative count representative of roll position, a pulse source, a bidirectional reference counter for maintaining a count representative of desired roll position, a digital subtractor for producing a difference signal, an analog-to-digital converter for producing an analog signal proportional to the digital difference signal, a servo amplifier and a continuously variable hydraulic valve for controlling the application of fluid pressure to the hydraulic screw-down apparatus. Also disclosed is an emergency stop preset register for dumping an emergency stop desired position into the reference counter when actuated.

5 Claims, 3 Drawing Figures

ADC
STRIP THICKNESS DETECTOR
ADC
LOGIC
CLEAR
UP
DOWN
E STOP
MAN
AUTO
EMERG. STOP
UP FAST
DOWN FAST
UP SLOW
DOWN SLOW
AND
NOT
FAST CLOCK
SLOW CLOCK

MILL HYDRAULIC SCREW-DOWN

This invention relates to control apparatus for rolling mills and, more particularly, digital apparatus for controlling the spacing between rolls in such a mill.

Rolling mills for working sheet material, particularly sheet metal, have been in existence for many years and over those years there has been a continuing effect to improve the control apparatus for refining the accuracy of the product. In its simplest form, a rolling mill involves two cylindrical rollers, one fixed and one movable, between which sheet material is caused to pass. The spacing between the rolls is less than the spacing of the material supplied thereto so that the material is compressed and thinned as it passes between the rolls. At one time, the movable one of the rolls was moved vertically by a threaded mechanism, and the apparatus for controlling thickness came to be known as a "screw-down". Although threaded mechanisms have in general given way to more modern methods, the apparatus is still generally known as a screw-down. Apparatus in present use usually employs hydraulic means for moving the movable roll.

Because of the resistance of the sheet material to compression, the rolls in contact with the sheet material tend to flex, resulting in a crown effect in the resulting sheet material. To avoid this effect, additional backup rolls are frequently provided resulting in a four roll mill, known as a "four-high" mill, or in a cluster of such backup rolls, a mill of this type being referred to as a cluster or "Z" mill. In the cluster mill, the backup rolls are commonly mounted eccentrically with rack and pinion arrangements connected to the hydraulic piston and cylinder assembly so that pressure is applied uniformly to the backup cluster which moves the movable roller. This rack and pinion assembly can involve a ratio of, for example, 20:1, meaning that a 20 unit movement of the rack involves a one unit movement of the movable roller. This arrangement results in additional accuracy of the roll movement.

As previously indicated, in any of these roll systems, various techniques have been employed to detect the effective roll position or the force applied to the roll and to change that force or position in order to produce a product having desired characteristics. One such system is illustrated in U.S. Pat. No. 3,566,638, Herbst (reissued as U.S. Pat. No. Re. 28,248 on Nov. 19, 1974), in which the roll is moved, either directly or in a four-high cluster mill arrangement, by piston and cylinder apparatus in which the position of the piston is detected by a linear voltage differential transformer. The analog signal thus produced is used to control a servo valve, the difference between actual and desired position being determined by a stepping motor and precision screw arrangement. While this system is operative, there are certain disadvantages inherent in this system because of the time required to operate the stepping motor which controls the position screw and because of the inherent difficulties of dealing with an analog signal. In any rolling mill operation it is desirable to respond as quickly as possible to an input signal so that a minimum amount of product which is not within tolerance is produced before the correction is effected. Also, in case of emergency circumstances, it is desirable to withdraw the rolls from the product immediately to avoid damage or injury.

Accordingly, it is an object of the present invention to provide a control apparatus for a mill screw-down in which extreme accuracy and rapid response are available.

Briefly described, the apparatus of the present invention includes a digital encoder coupled to the movable portion of the piston and cylinder means for driving the movable mill roll for producing digital signals representative of the magnitude and direction of motion of the piston, bidirectional position counter means for receiving and counting the digital signals and for maintaining a cumulative count representative of roll position, a bidirectional reference counter for maintaining a count representative of desired roll position, means including a pulse source for selectively delivering pulses to the reference counter, digital summing means connected to the bidirectional counter and the bidirectional reference counter or producing a digital signal representative of the difference between actual roll position and desired roll position, a servo valve connected to a source of fluid under pressure and to the piston and cylinder means driving the movable roll, and converter circuit means connected to the summing means for converting the signal representative of the difference and for delivering a drive signal to the servo valve, the valve being responsive to the drive signal to deliver fluid under pressure to the cylinder whereby the roll is driven to the desired position.

In order that the manner in wich the foregoing and other objects are attained in accordance with the invention can be understood in detail, a particularly advantageous embodiment thereof will be described with reference to the accompanying drawings, which form a part of this specification, and wherein.

Figure 1:
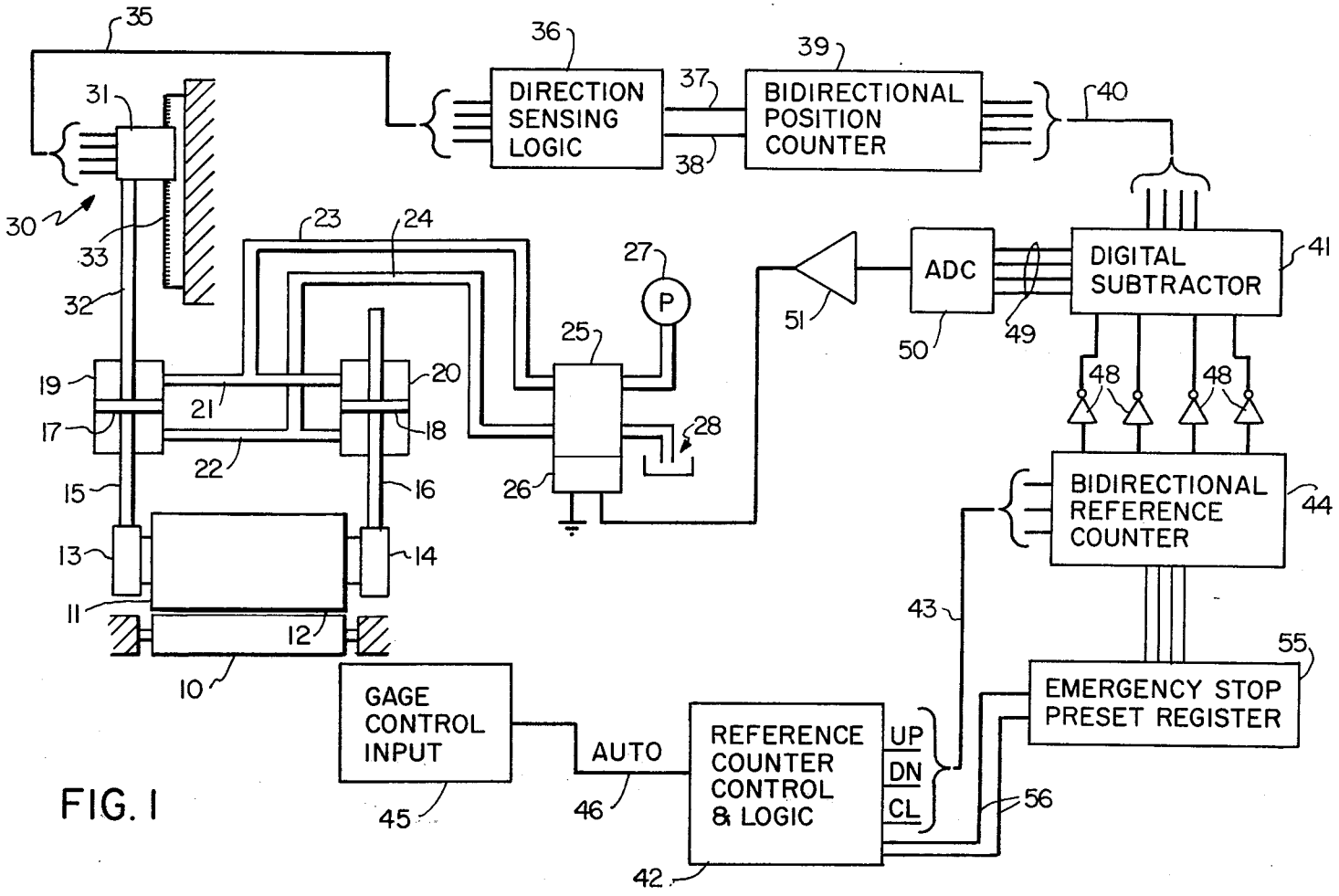
FIG. 1 is a schematic diagram, partly in block form, of a system according to the present invention.

Referring first to FIG. 1, the apparatus of the present invention is designed for use with a conventional rolling mill which has a lower, fixed roller 10 and an upper movable roller 11 with a variable gap therebetween through which a workpiece 12, such as a sheet of metal, can be passed to alter the thickness of the workpiece. As previously indicated, the invention is usable with standard mills such as four-high or cluster mills, but the simplest form of such a mill is depicted in FIG. 1 for clarity.

Movable roller 11 is journaled for rotation about its central axis in conventional bearing means 13 and 14, the bearing means being supported and moved by rods 15 and 16 which are connected to pistons 17 and 18 carried within cylinders 19 and 20, respectively. Hydraulic conduits 21 and 22 are connected in parallel fluid circuit relationship to the upper and lower portions of cylinders 19 and 20, these conduits being connected respectively to conduits 23 and 24 which are connected to a variable position servo valve 25. Valve 25 is driven by an electrically actuated valve operator 26. Valve 25 is connected to a source of hydraulic fluid under pressure such as pump 27 and to a reservoir indicated generally at 28 in a conventional fashion. As will be recognized by those skilled in the art, valve 25 is of the continuously variable type which is movable by motor 26 to provide fluid under pressure through either of conduits 23 or 24, the pressure supply through either of those conduits being variable depending upon valve position. Pressure supplied through conduit 23 causes both of pistons 17 and 18 to move downwardly while pressure supply through conduit 24 tends to urge the pistons upwardly. The speed of movement of the pistons is a function of the relative pressure supplied through conduits 23 and 24 and, hence, through conduits 21 and 22.

A position responsive means indicated generally at 30 is directly connected to at least one of the pistons, this position responsive means in FIG. 1 taking the form of an optical encoder having a movable element 31 carried by and movable with a shaft 32 connected to piston 17. The encoder also includes a fixedly mounted scale 33 having a plurality of graduations marked thereon. Scale 33 is fixedly mounted with respect to the fixed roll and the cylinders of the rolling mill so that any relative motion between the movable roll and the fixed portions of the apparatus result in relative motion between the movable portion of the encoder 31 and scale 33.

Encoder 31 and scale 33 constitute a high resolution, high precision linear encoder which is conventional in nature and which, in itself, is not represented as being unique. A suitable encoder for use with the system of FIG. 1 is disclosed in U.S. Pat. No. 3,496,364, Foskett et al., and is marketed by Dynamics Research Corporation, Wilmington, Mass., as the LMS Series of Lanier encoders. These encoders use a scale 33 which is a ruled glass scale having for example, 1250 lines per inch, the lines being opaque. Movable head 31 has a U-shaped recess which partially surrounds the scale and which includes a light source, a reflective prism system and a photovolteic-sensor array so that light passes through the scale, is reflected in a direction parallel to the scale, and then is caused to pass back through the scale and to impinge upon the sensor array. The output of the movable head constitutes four channels of information, two channels being the logical inverse of the other two channels. Thus, two channels constitute rectangular pulses as the head moves along the scale, the pulses being separated in phase by 90 . The other two channels are therefore also separated in phase by 90 but are the inverse of the first two. For a more detailed discussion of this portion of the apparatus, reference is made to the above-identified Foskett et al patent.

The four channels of information are carried on a four conductor cable 35 to a direction sensing logic unit 36 which algebraically combines the four channels of information to produce a train of pulses on one or the other of conductors 37 and 38, one train of pulses representing movement of the optical head and, hence, piston 17 in an upward direction and a train of pulses on the other conductor representing movement in a downward direction. These pulses are provided to a bidirectional position counter 39. Counter 39 is a conventional bidirectional digital counter capable of accumulating these pulses and maintaining a cumulative count representative of roll position. The resulting count, in conventional binary code, appears on the conductors at the output of counter 39 and is delivered, on a cable 40, to one input of a digital subtractor unit 41.

A reference counter control and logic unit 42, to be described in greater detail hereinafter, is capable of selectively producing pulses which are delivered on a multiconductor cable 43 to a bidirectional counter unit 44 which can be preset to accumulate a count representative of the desired position of roll 11. Switch means in unit 42 can be activated to deliver a predetermined number of pulses in either an up or down direction to establish this count in unit 44. Alternatively, for an automatic control system, a gauge control unit 45 can be associated with the product 12 merging from between rolls 10 and 11 to measure the thickness, or some other characteristic of that product and to produce pulses delivered to unit 42 on a conductor 46 to continuously alter the output of unit 42 and, thereby, to change the count in reference counter 44, as needed to adjust the position of the roll as the apparatus is operated.

Counter 44 thus maintains a count representative of desired roll position and provides an output in digital binary form to inverters 48 which invert the signals at the output of the counter and provide the signals to the input of digital subtractor 41.

Unit 41 is a conventional device for adding digital pulses and providing the sum of such pulses at the output of that unit on conductors 49. In order to obtain a difference between the count maintained in counter 39 and that maintained in counter 44, a "2's complement" addition technique is used wherein the signals from one of the counters is inverted. Thus, when these digital signals provided from inverters 48 and on conductor 40 are added in unit 41, the result is a difference signal. This signal is supplied to an analog-to-digital converter unit 50 which produces an analog signal, the magnitude of which is representative of the difference between the count maintained in units 39 and 44. This analog signal is delivered to a servo amplifier 51 which provides sufficient power to drive motor 26 which operates servo valve 25, thereby causing the fluid under pressure to drive pistons 17 and 18 in the proper direction.

Converter 50 is also, in itself, a conventional device and a number of such converters are currently available on the market to perform the desired function. A typical device usable for this purpose is available from Datel Systems, Inc., of Canton, Mass., and is sold under the identification of DAC–169 Series. The input to this converter is 16 bits and the output is an analog signal the magnitude of which lies between zero and 5 volts dc.

While the operation of this system is believed to be clear from the foregoing description, a brief summary thereof follows. Initially, the servo valve 25 is manually actuated, by means not shown, so that rolls 10 and 11 are in contact with each other. The digital system including counter 39 is then cleared so that the count stored therein represents a zero position. A desired count is then entered in reference counter 44 by operating suitable switches in control unit 42 to produce a desired number of pulses on conductor 43. The system is then fully energized, at which time subtractor 41 is provided with a desired position count from inverters 48 and an actual position count of zero on conductor 40. The output from subtractor 41, converter 50 and amplifier 51 is therefore maximum, causing valve 25 to operate so that maximum fluid pressure is applied on conduits 24 and 22, driving the roll upwardly. As the roll moves, encoder head 31 moves along scale 33 and pulses are produced indicating upward movement on conductor 35 and one of conductors 37 and 38.

Counter 39 then accumulates a count representative of this upward motion and provides an output representative of actual roll position as it moves upwardly on conductors 40. Subtractor unit 41 is then continually producing a smaller and smaller signal so that valve 25 is continually adjusted to represent the fact that the roll is approaching its desired position. When its desired position is reached, the subtractor output is zero and the valve is moved to a neutral position. The work material 12 can then be passed through the rolls and the desired position, if any, can be further adjusted by producing pulse outputs from control unit 42.

As previously indicated, the mill output can be monitored by gauge control unit 45, permitting a continuous control of the input to reference counter 44.

For safety purposes, it is always desirable to provide emergency stop techniques. For this purpose, there is provided an emergency stop preset register 55 to which pulses can be provided from control unit 42 on one of conductors 56. The count preset into register 55 would normally be a "maximum open" count, i.e., a count width, if it were placed in reference counter 44 would result in rolls 10 and 11 being moved apart to the maximum desired spacing. This count is simply maintained in preset register 55 until such time as an emergency situation arises, whereupon an actuating signal from control unit 42 can be supplied on the other one of conductors 56, causing this count to immediately replace any count which previously existed in reference counter 44. The output from subtractor 41 would then immediately change to represent the difference between the actual roll position and the desired emergency space, causing motor 26 to drive valve 25 in a direction to cause the rolls to move to that position.

Figures 2, 3:
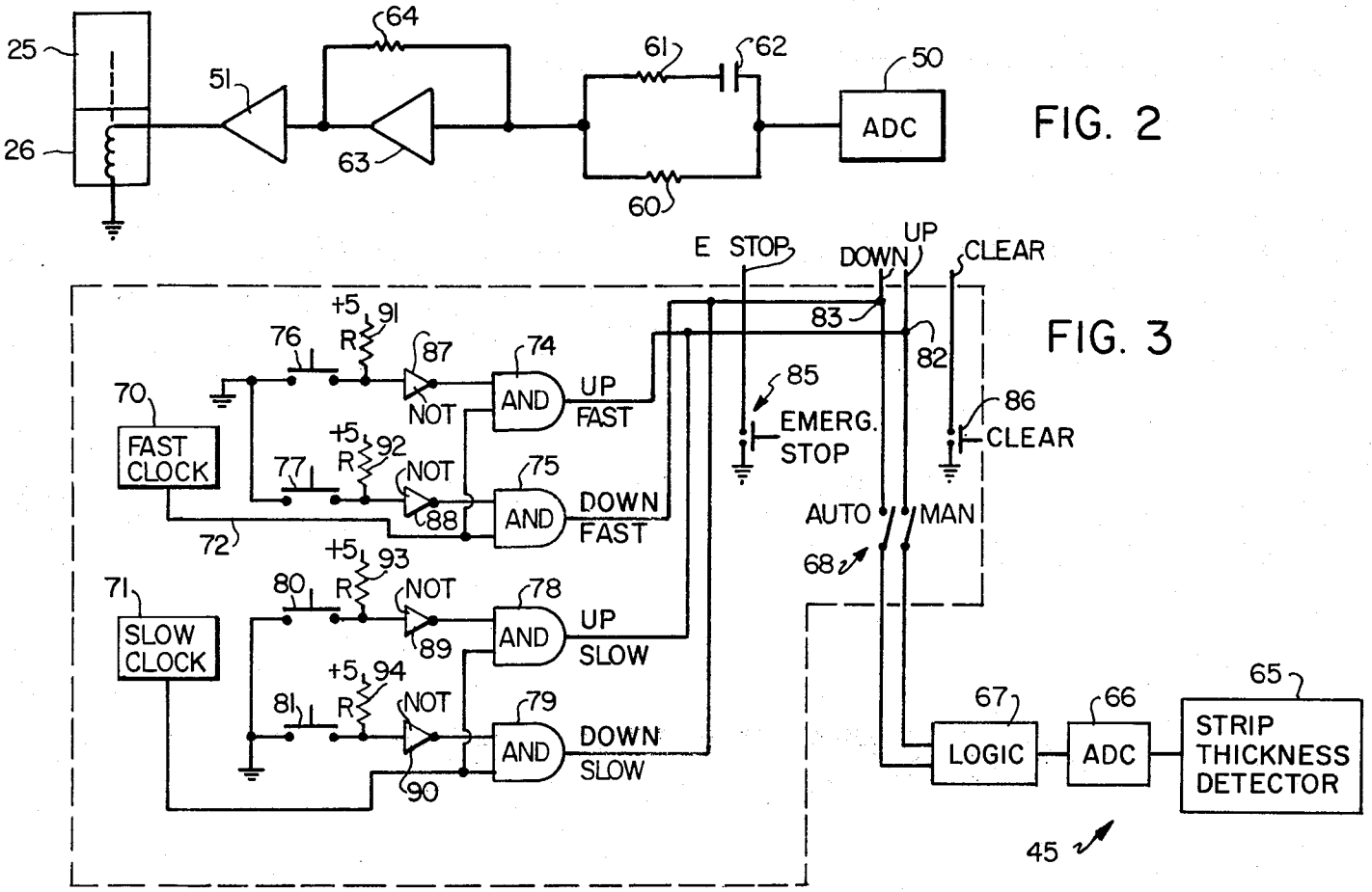
FIG. 2 is a schematic diagram, partly in block form, of an error and rate servo amplifier circuit usable in the apparatus of FIG. 1.
FIG. 3 is a schematic diagram, partly in block form, of a pulse producing reference counter control and logic unit usable in the apparatus of FIG. 1.

FIG. 2 represents a further improvement on the system of FIG. 1 in which rate information is incorporated in the signal supplied to motor 26 driving valve 25. As shown therein, the output of converter 50 is supplied to a parallel circuit including a resistor 60 in parallel circuit relationship with a series circuit including a resistor 61 and a capacitor 62. This parallel circuit is connected to the input of an operational amplifer 63 which has a resistor 64 connected between its input and output. The output of amplifier 63 is connected to servo amplifier 51, as previously described.

Under normal operating circumstances, the output of converter 50 is supplied through resistor 60 to amplifier 63 and servo amplifier 51. As usual, the gain of amplifier 63 is determined by the ratio of resistors 64 and 60. However, if the output of converter 50 changes suddenly, as in the case of a large error or an emergency situation, this more rapidly changing signal is coupled through capacitor 62 and resistor 61 in addition to resistor 60, giving the appearance of a significantly larger error signal at the input of amplifier 63 and effectively increasing the gain of that amplifier and its associated circuitry. Thus, the signal which appears at the input to servo amplifier 51 is larger than the normal error signal which would be produced by an equivalent difference at the output of subtractor 41. Motor 26 is therefore driven to move valve 25 so that the pressure applied to the piston and cylinder means drives the roll more rapidly toward the desired position. As the desired position is approached, the rate signal has increasingly less effect, returning the system to a direct signal following mode of operation.

FIG. 3 shows, in more detail, the pulse sources associated with control unit 42, and apparatus which can be employed as the gauge control input for automatic operation. As shown therein, a strip thickness detector of convention type, such as that shown in U.S. Pat. No. 3,841,123, Fox et al., can be used to monitor the output of the rolling mill. The output of this detector, if in analog form, can be connected to an analog-to-digital converter 66 to convert the signal to a pulse form. Suitable logic 67 can then be employed to place this signal in a form acceptable to counter 44 and can be switched, through auto-manual switches 68 in unit 42 to the up-down counter inputs of counter 44.

For normal setting of reference counter 44 in the operation as previously described, there is provided a fast source of clock pulses 70 and a slow source of clock pulses 71. Clock 70 constitutes a pulse oscillator capable of providing pulses at a relatively high rate such as, for example, 1,600 pulses per second, while clock 71 is a similar device capable of producing pulses at, for example, the rate of 200 pulses per second. The pulse output of clock 70 is provided on conductor 72. Conductor 72 is connected to the inputs of AND gates 74 and 75, the other inputs of these gates being connected to NOT gates 87 and 88 and through manually operable switches 76 and 77, respectively, to ground. The similar output of clock 71 is connected to inputs of gates 78 and 79, the other inputs of which are connected to NOT gates 89 and 90 and through switches 80 and 81, respectively, to ground. The outputs of gates 74 and 78 are connected to a common "up" pulse output junction 82 and the outputs of gates 75 and 79 are connected to a similar output junction 83, junctions 82 and 83 constituting the up and down output terminals which are connected through cable 43 to counter 44 as shown in FIG. 1. The emergency stop and clear output are connected through manually operable switches 85 and 86, respectively, to ground.

From this it will be recognized that in order to set counter 44, assuming that an up count is desired, the operator depresses switch 76, enabling gate 74 and permitting it to pass up pulses from clock 70 to the up input of counter 44. As the counter approaches the desired count, the operator can release switch 76 and depress switch 80, permitting pulses to be delivered to the up input of the counter at a slower rate so that the desired count can be reached more easily. If the count is bypassed inadvertently, or for the purpose of resetting the counter to a lower count, switches 77 or 81 can be depressed in a similar fashion, delivering pulses to the down input of the counter 44 to permit it to count in the opposite direction. The emergency stop and clear switches and their functions are believed to be obvious to one skilled in the art.

While certain advantageous embodiments have been chosen to illustrate the invention, it will be understood by those skilled in the art that various changes and modifications can be made therein without departing from the scope of the invention as found in the appended claims.

What is claimed is:

1. An apparatus for controlling the position of a roll in a rolling mill of the type having first and second rolls, means for passing a length of material between the rolls for altering the thickness thereof, hydraulic piston and cylinder means coupled to the first one of the rolls for changing the position of the first roll to change the spacing between the rolls, and a source of hydraulic fluid under pressure, the apparatus comprising the combination of:

position responsive means directly coupled to the piston of the piston and cylinder means and movable therewith, said position responsive means including optical encoder means for producing digital electrical signals representative of the magnitude and direction of motion of said piston;

bidirectional position counter means for receiving and counting said digital signals and for maintaining a cumulative count representative of roll position;

bidirectional reference counter means for maintaining a count representative of desired roll position;

means including a pulse source for selectably delivering pulses to said reference counter means to establish a count representative of desired roll position;

digital summing means connected to said bidirectional position counter and to said bidirectional reference counter for producing a digital signal representative of the difference between actual roll position and desired roll position;

a servo valve connected to the source of fluid under pressure and to the piston and cylinder means; and converter circuit means coupled to said summing means for converting said signal representative of the difference and for delivering a proportional drive signal to said servo valve, said valve being responsive to said drive signal to deliver fluid under pressure to the piston and cylinder means whereby said roll is driven toward said desired position.

2. An apparatus according to claim 1 and further comprising a preset register;

switch means for selectively delivering pulses from said means including a pulse source for establishing an emergency stop position count in said preset register; and switch means for instantaneously supplying the count in said preset register to said bidirection counter for establishing an emergency stop desired position count therein.

3. An apparatus according to claim 1 wherein said converter circuit means includes an analog-to-digital converter; and a servo amplifier connected to receive the output of said analog-to-digital converter.

4. An apparatus according to claim 3 wherein said converter circuit means includes rate circuit means for providing to said servo amplifier a signal of increased magnitude proportional to the rate of change of the proportional signal supplied by said analog-to-digital converter.

5. An apparatus according to claim 1 wherein said means including a pulse source further comprises means for producing a signal representative of the thickness of material passed between the rolls; and means for delivering to said bidirectional reference counter a signal representative of the difference between desired material thickness and the thickness of the material passed between the rolls.

* * * * *